US009837031B2

(12) United States Patent
You

(10) Patent No.: US 9,837,031 B2
(45) Date of Patent: Dec. 5, 2017

(54) APPARATUS AND METHOD FOR DRIVING LIQUID CRYSTAL DISPLAY DEVICE

(75) Inventor: Song Ryol You, Chungcheongbuk-do (KR)

(73) Assignee: LG DISPLAY CO., LTD., Seoul (KR)

( * ) Notice: Subject to any disclaimer, the term of this patent is extended or adjusted under 35 U.S.C. 154(b) by 1699 days.

(21) Appl. No.: 11/594,167

(22) Filed: Nov. 8, 2006

(65) Prior Publication Data

US 2007/0146273 A1 Jun. 28, 2007

(30) Foreign Application Priority Data

Dec. 28, 2005 (KR) ..... 10-2005-0131259

(51) Int. Cl.
*G09G 3/36* (2006.01)

(52) U.S. Cl.
CPC ... *G09G 3/3648* (2013.01); *G09G 2320/0252* (2013.01); *G09G 2320/0261* (2013.01); *G09G 2320/0285* (2013.01); *G09G 2340/16* (2013.01)

(58) Field of Classification Search
USPC ..... 345/89, 204, 690
See application file for complete search history.

(56) References Cited

U.S. PATENT DOCUMENTS 3,696,268 A * 10/1972 Exner ..... 315/151
6,181,263 B1 * 1/2001 Malik et al. ..... 341/118
7,126,156 B2 * 10/2006 Yamazaki ..... G09G 3/3688 257/59
7,202,641 B2 * 4/2007 Claessens et al. ..... 323/222
2004/0140985 A1 * 7/2004 Liaw ..... 345/690
2005/0253833 A1 * 11/2005 Teshirogi et al. ..... 345/204
2006/0006928 A1 * 1/2006 Utsuno ..... G09G 3/3688 327/541
2006/0066253 A1 * 3/2006 Kim ..... G09G 3/3233 315/169.3

FOREIGN PATENT DOCUMENTS

| | | |
|---|---|---|
| JP | 2004-302160 | 10/2004 |
| TW | 200405990 | 4/2004 |
| TW | 200414114 | 8/2004 |

* cited by examiner

*Primary Examiner* — William Boddie
*Assistant Examiner* — Leonid Shapiro
(74) *Attorney, Agent, or Firm* — Dentons US LLP

(57) ABSTRACT

An apparatus and method for driving an LCD device is disclosed to obtain rapid response speed and to enhance picture quality, in which the apparatus includes a liquid crystal panel that includes liquid crystal cells formed in areas defined by gate and data lines; a gate driver that supplies a scan pulse to the gate lines; a timing controller that modulates source data supplied from the external to modulated data for a rapid response speed of liquid crystal cell, and generates discrimination signals by comparing source data of a current frame with uppermost and lowermost gray scales of source data based on whether source data of a current frame is the same as source data of a previous frame or not; and a data driver that converts the modulated data into a video signal by using a plurality of gamma voltages including a first modulation voltage that is higher than an maximum gamma voltage or a second modulation voltage that is lower than a minimum gamma voltage, and supplies the video signal to the data lines.

9 Claims, 8 Drawing Sheets

APPARATUS AND METHOD FOR DRIVING LIQUID CRYSTAL DISPLAY DEVICE

This application claims the benefit of Korean Patent Application No. P2005-131259, filed on Dec. 28, 2005, which is hereby incorporated by reference for all purposes as if fully set forth herein.

BACKGROUND OF THE INVENTION

Field of the Invention

The present invention relates a liquid crystal display (LCD) device, and more particularly, to an apparatus and method for driving an LCD device to provide improved picture quality.

Discussion of the Related Art

Generally, LCD devices adjust light transmittance of liquid crystal cells according to a video signal to display an image. An active matrix type LCD device, which has a switching element for every liquid crystal cell, is suitable for the display of a moving image. A thin film transistor (hereinafter, referred to as a TFT) is mainly used as the switching element in the active matrix type LCD device.

However, the LCD device has a relatively low response speed due to characteristics such as the inherent viscosity and elasticity of liquid crystal, as can be seen from the following equations 1 and 2:

$$\tau_r \propto \frac{\gamma d^2}{\Delta\varepsilon|V_a^2 - V_F^2|} \quad \text{[Equation 1]}$$

where $\tau_r$ is a rising time when a voltage is applied to the liquid crystal, $V_a$ is the applied voltage, $V_F$ is a Freederick transition voltage at which liquid crystal molecules start to be inclined, d is a liquid crystal cell gap, and y is the rotational viscosity of the liquid crystal molecules.

$$\tau_F \propto \frac{\gamma d^2}{K} \quad \text{[Equation 2]}$$

where $\tau_F$ is a falling time when the liquid crystal is returned to its original position because of an elastic restoration force after the voltage applied to the liquid crystal is turned off, and K is the inherent elastic modulus of the liquid crystal.

In a twisted nematic (TN) mode, although the response speed of the liquid crystal may be different according to the physical properties and cell gap of the liquid crystal, it is common that the rising time is 20 to 80 ms and the falling time is 20 to 30 ms. Because this liquid crystal response speed is longer than one frame period (16.67 ms in National Television Standards Committee (NTSC)) of a moving image, the response of the liquid crystal proceeds to the next frame before a voltage being charged on the liquid crystal reaches a desired level, as shown in FIG. 1, resulting in motion blurring in which an afterimage is left in the eyeplane.

With reference to FIG. 1, a related art LCD device cannot express a desired color and brightness for display of a moving image in that, when data VD is changed from one level to another level, the corresponding display brightness level BL is unable to reach a desired value due to a slow response of the liquid crystal display device. As a result, the motion blurring occurs in the moving image, causing degradation in contrast ratio and, in turn, degradation in display quality.

In order to solve the low response speed of the liquid crystal display device, U.S. Pat. No. 5,495,265 and PCT International Publication No. WO 99/09967 has proposed a method for modulating data according to a variation therein using a look-up table (referred to hereinafter as an 'over-driving method'). This over-driving method is adapted to modulate data on the basis of a principle as illustrated in FIG. 2.

With reference to FIG. 2, the related art over-driving method includes modulating input data VD and applying the modulated data MVD to a liquid crystal cell to obtain a desired brightness level MBL. In this over-driving method, in order to obtain the desired brightness level corresponding to the luminance of the input data in one frame period, the response of a liquid crystal is rapidly accelerated by increasing $|V_a^2 - V_F^2|$ Equation 1 on the basis of a variation in the input data.

Accordingly, a related art liquid crystal display device using the over-driving method is able to compensate for a slow response of a liquid crystal by modulation of a data value to relax motion blurring in a moving image to display a picture with a desired color and brightness.

For this, a related art over-driving circuit includes a frame memory 302 connected to a bus line 301, and a look-up table 303 connected in common to output terminals of the bus line 301 and the frame memory 302, as illustrated in FIG. 3.

The frame memory 302 stores data (RGB) from the bus line 301 for one frame period and supplies the stored data (RGB) to the look-up table 303. The look-up table 303 compares data (RGB) of a current frame (Fn) from the bus line 301 with data (RGB) of a previous frame (Fn−1) from the frame memory 302, and selects modulated data (MRGB) corresponding to the comparison result.

However, the related art over-driving method has the following disadvantages.

In the related art over-driving method, in case of 8-bit data, it cannot be driven by a voltage which is higher than a value corresponding to gray scale 255 of the uppermost gray scale. Accordingly, if the gray scale is changed from gray 0 of the lowermost gray scale to gray 255, the LCD device is driven by the voltage corresponding to the gray scale 255 without modulating a data voltage to a higher voltage than the value corresponding to the gray scale 255.

In the related art over-driving method, it is difficult to obtain the rapid response of liquid crystal for the lowermost or uppermost gray scale. Thus, it is difficult to improve the picture quality.

SUMMARY OF THE INVENTION

Accordingly, the present invention is directed to an apparatus and method for driving an LCD device that substantially obviates one or more problems due to limitations and disadvantages of the related art.

An advantage of the present invention is to provide an apparatus and method for driving an LCD device to improve picture quality.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, an apparatus for driving an LCD device comprises a liquid crystal panel including liquid crystal cells formed in areas defined by gate and data lines; a gate driver to supply a scan pulse to the gate lines; a timing controller to modulate source data supplied from an external source to generate modulated data and to generate discrimination signals by comparing source data of a current frame with uppermost and lowermost gray levels of source data if source data of a current frame is the different from source data of a previous frame; and a data driver to convert the modulated data into a video signal using a plurality of gamma voltages including a first modulation voltage that is higher than a maximum gamma voltage or a second modulation voltage that is lower than a minimum gamma voltage and to supply the video signal to the data lines.

In another aspect of the present invention, a method for driving an LCD device having a liquid crystal panel including a plurality of liquid crystal cells formed in areas defined by gate and data lines comprises modulating source data supplied from an external source to modulated data; generating a discrimination signal by comparing source data of a current frame with uppermost and lowermost gray scales of source data if source data of a current frame is different from source data of a previous frame; supplying a scan pulse to the gate lines; converting the modulated data to a video signal by using a plurality of gamma voltages including a first modulation voltage that is higher than a maximum gamma voltage or a second modulation voltage that is lower than a minimum gamma voltage, according to the discrimination signal; and supplying the converted video signal to the data lines in synchronization with the scan pulse.

In another aspect of the present invention, a method of generating a gamma voltage in a liquid crystal display device includes comparing a source data of a current frame with source data of a previous frame; generating a first comparison signal if the source data of the current frame is different from source data of the previous frame and generating a second comparison signal if the source data of the current frame is the same as the source data of the previous frame; outputting the source data of the current frame in response to the first comparison signal; comparing source data of the current frame with the a first reference value and a second reference value; outputting a first discrimination signal if the source data of the current frame is the same as the first reference value and outputting a second discrimination value if the source data of the current frame is the same as a second reference value; and generating a first gamma voltage value in response to the first discrimination signal and generating a second gamma voltage value in response to the second discrimination signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, an apparatus and method for driving an LCD device according to the present invention will be explained with reference to the accompanying drawings.

Figure 1:
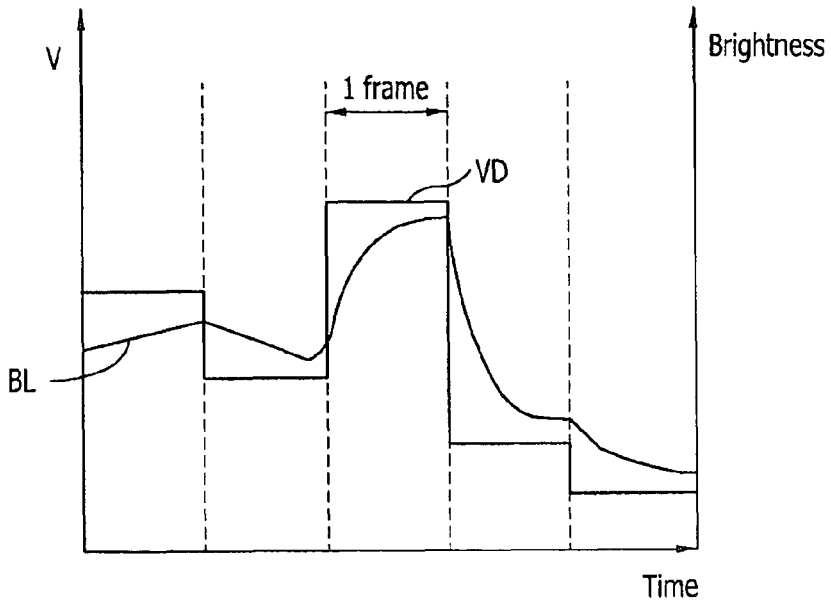
FIG. 1 Related Art
FIG. 1 is a graph illustrating a response speed of an LCD device according to the related art.
Figure 2:
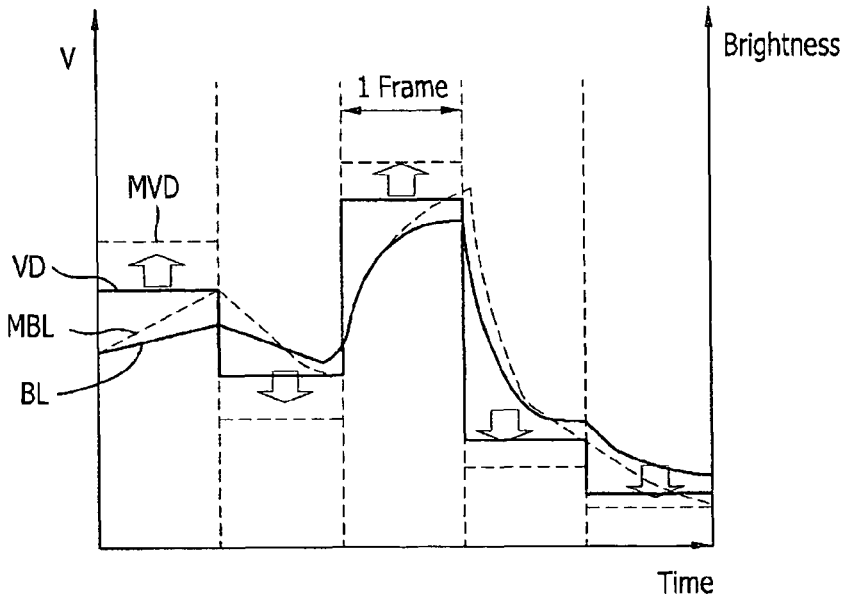
FIG. 2 Related Art
FIG. 2 is a graph illustrating a response speed of an LCD device to which an over-driving method is applied.
Figure 3:
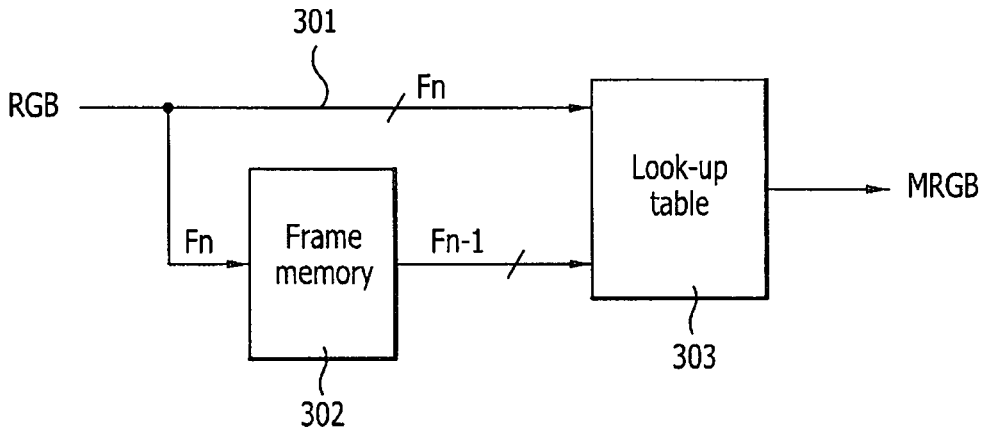
FIG. 3 Related Art
FIG. 3 is a block diagram illustrating an over-driving circuit according to the related art.
Figure 4:
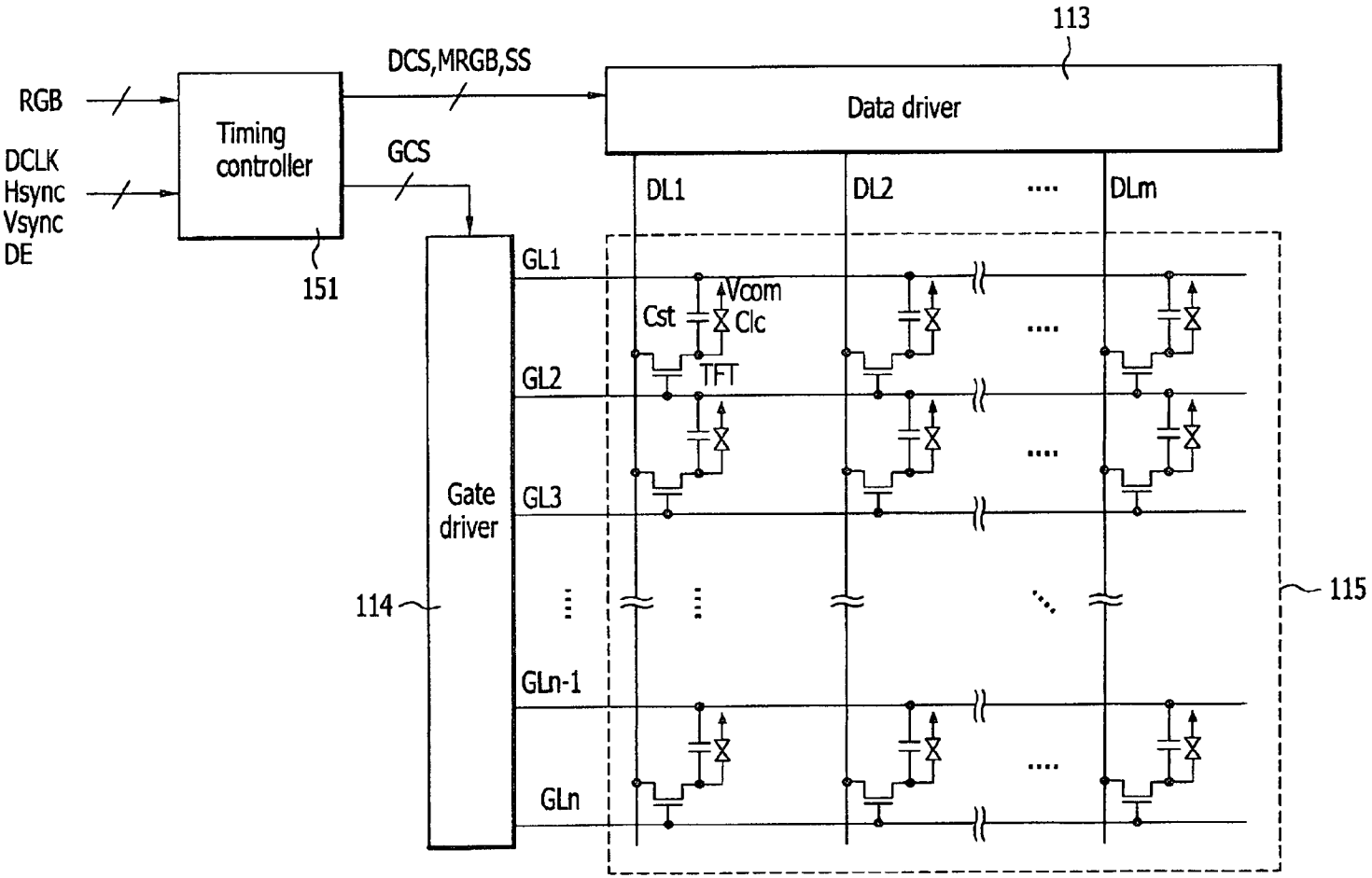
FIG. 4 illustrates a driving apparatus of an LCD device according to an embodiment of the present invention.

FIG. 4 illustrates an apparatus for driving an LCD device according to an embodiment of the present invention.

Referring to FIG. 4, the apparatus for driving the LCD device according to an embodiment of the present invention includes a liquid crystal panel 115 that includes a plurality of gate lines (GL1 to GLn) and a plurality of data lines (DL1 to DLm) arranged substantially perpendicular to each other, and a plurality of thin film transistors adjacent to crossings of the gate and data lines; a timing controller 151 that modulates source data (RGB) supplied from an external source to modulated data (MRGB) for a quicker response speed of liquid crystal cell and generates discrimination signals (SS) after comparing source data (RGB) of a current frame with uppermost and lowermost gray scales of source data (RGB) based on whether source data (RGB) of a current frame is the same as source data (RGB) of a previous frame; a gate driver 114 that supplies a scan pulse to the gate lines (GL1 to GLn) under control of the timing controller 151; and a data driver 113 that converts the modulated data (MRGB) to video signals using a plurality of gamma voltages including a first modulation voltage that is higher than a maximum gamma voltage or a second modulation voltage that is lower than a minimum gamma voltage and supplies the video signals to the data lines (DL1 to DLm).

The liquid crystal panel 115 also includes a plurality of liquid crystal cells (Clc) and respective thin film transistors TFT arranged at respective crossings of the gate lines (GL1 to GLn) and data lines (DL1 to DLm) in a matrix type. Each thin film transistor provided in each of the liquid crystal cells supplies the video signal provided from the data lines (DL1 to DLm) to the liquid crystal cell (Clc) in response to a scan signal provided from the gate line (GL). Also, each liquid crystal cell includes a storage capacitor (Cst) to maintain a voltage of the liquid crystal cell (Clc) substantially uniformly. The storage capacitor (Cst) may be formed between a pixel electrode of the liquid crystal cell (Clc) and the prior gate line, and/or between a pixel electrode of the liquid crystal cell (Clc) and a common electrode line.

The timing controller 151 controls the data and gate drivers 113 and 114 by generating a data control signal (DCS) for controlling the data driver 113, and a gate control signal (GCS) for controlling the gate driver 114 with synchronized signals (Vsync, Hsync, DE, DCLK) inputted from an external source.

Also, the timing controller 151 generates the modulated data (MRGB) and discrimination signal (SS) and supplies the data driver 113 with the modulated data (MRGB) and discrimination signal (SS).

Figure 5:
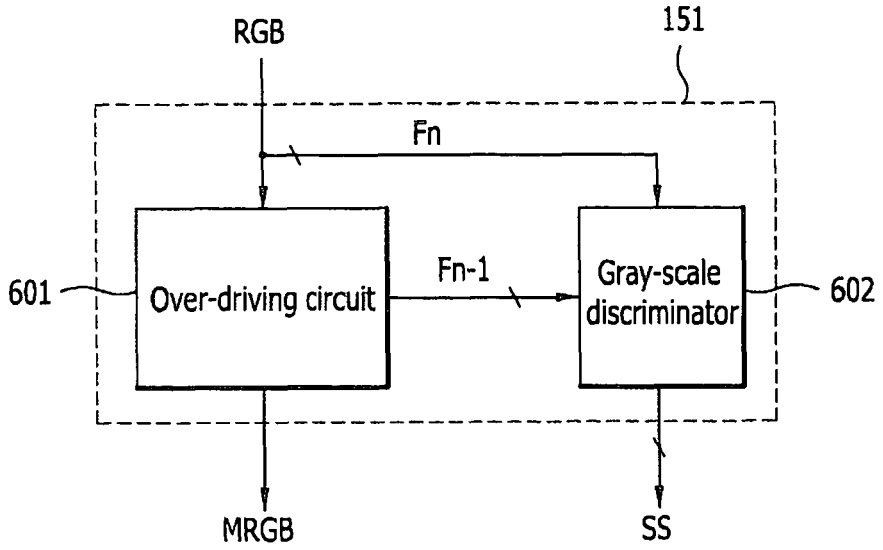
FIG. 5 is a block diagram illustrating a timing controller of FIG. 4.

For this, as illustrated in FIG. 5, the timing controller 151 may include an over-driving circuit 601 that generates the modulated data and a gray-scale discriminator 602 that generates the discrimination signal (SS).

Figure 6:
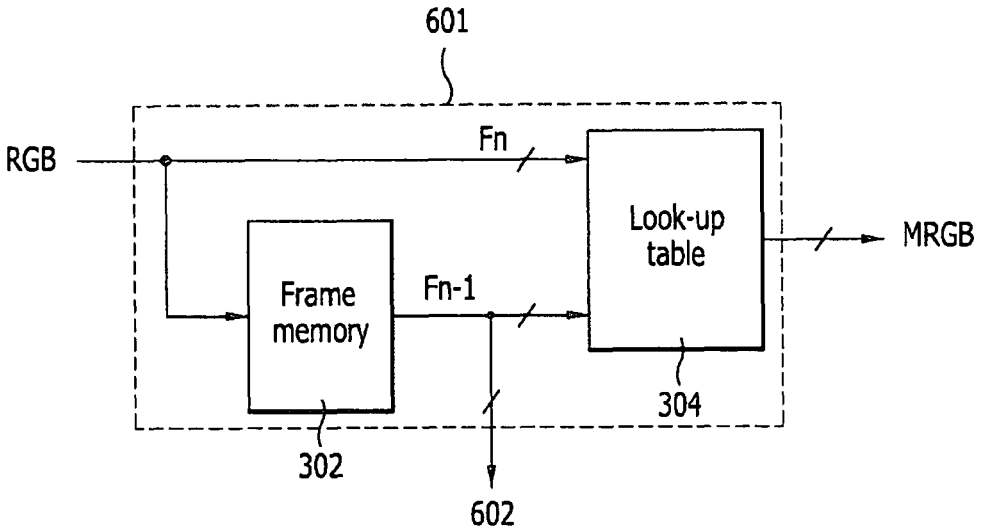
FIG. 6 is a block diagram illustrating an over-driving circuit of FIG. 5.

As illustrated in FIG. 6, the over-driving circuit 601 is provided with a frame memory 302 and a look-up table 304. The frame memory 302 stores source data (RGB) inputted from an external source for one frame period. In this case, the source data (RGB) stored in the frame memory 302 is supplied to the look-up table 304 and the gray-scale discriminator 602.

The look-up table 304 compares source data (RGB) of a current frame (Fn) inputted from the external source with source data (RGB) of a previous frame (Fn−1) inputted from the frame memory 302 and generates modulated data (MRGB) for a rapid response speed of liquid crystal.

Figure 7:
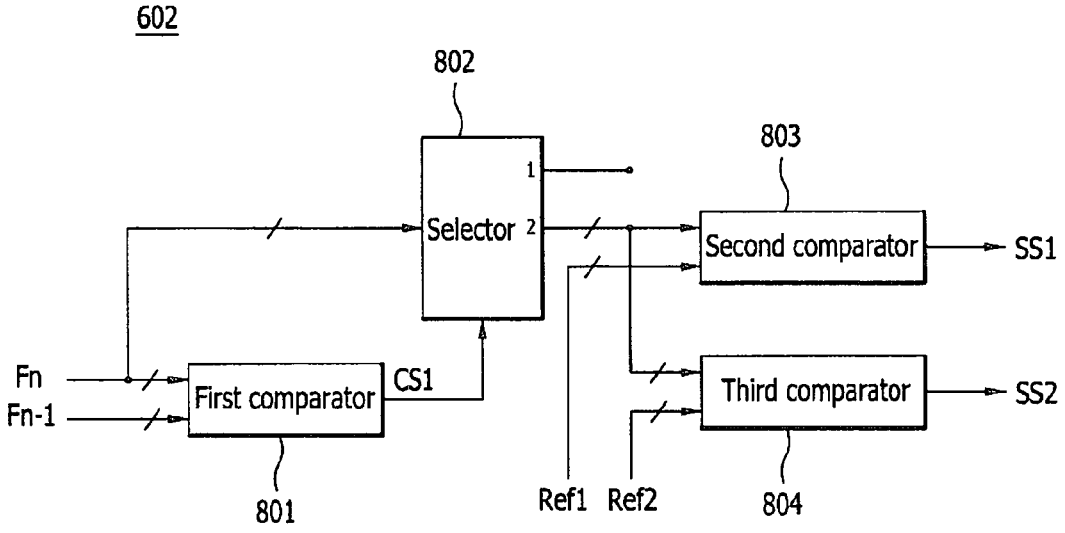
FIG. 7 is a block diagram illustrating a gray scale discriminator of FIG. 5.

The gray-scale discriminator 602 of FIG. 5 may include a first comparator 801, a selector 802, and second and third comparators 803 and 804, as illustrated in FIG. 7.

The first comparator 801 compares the source data of the current frame (Fn) with the source data of the previous frame (Fn−1) inputted from the frame memory 302. If the source data of the previous frame supplied to each pixel is the same as the source data of the current frame, the first comparator 801 generates a comparison signal (CS1) of a first state (e.g., a high state). If the source data of the previous frame supplied to each pixel is different from the source data of the current frame, the first comparator 801 generates a comparison signal (CS1) of a second state (e.g., a low state).

For example, if the first comparator 801 supplies the comparison signal (CS1) of the first (high) state to the selector 802, the selector 802 outputs the source data of the current frame (Fn) to a first output terminal 1 in a floating state. Meanwhile, if the first comparator 801 supplies the comparison signal (CS1) of the second (low) state to the selector 802, the selector 802 outputs the source data of the current frame (Fn) to the second and third comparators 803 and 804 through a second output terminal 2.

The second comparator 803 compares the source data of the current frame (Fn) supplied from the selector 802 with a first reference signal (Ref1) corresponding to a preset uppermost gray scale and generates a first discrimination signal (SS1). At this time, if the source data of the current frame (Fn) is the same as the first reference signal (Ref1), the second comparator 803 generates a first discrimination signal (SS1) of a first state (e.g., a high state). If the source data of the current frame (Fn) is different from the first reference signal (Ref1), the second comparator 803 generates a first discrimination signal (SS1) of a second state (e.g., a low state).

The third comparator 804 compares the source data of the current frame (Fn) supplied from the selector 802 with a second reference signal (Ref2) corresponding to a preset lowermost gray scale and generates a second discrimination signal (SS2). At this time, if the source data of the current frame (Fn) is the same as the second reference signal (Ref2), the third comparator 804 generates a second discrimination signal (SS2) of a first state (e.g., a high state). If the source data of the current frame (Fn) is different from the second reference signal (Ref2), the third comparator 804 generates a second discrimination signal (SS2) of a second state (e.g., a low state).

If the source data supplied to the pixel of the current frame (Fn) is identical in gray scale to the source data of the previous frame (Fn), or the source data of the current frame (Fn) is not the uppermost gray scale, the gray-scale discriminator 602 generates the first discrimination signal (SS1) of the second state. Also, if the source data supplied to the pixel of the current frame (Fn) is identical in gray scale to the source data of the previous frame (Fn−1), or the source data of the current frame (Fn) is not the lowermost gray scale, the gray-scale discriminator 602 generates the second discrimination signal (SS2) of the second state.

Meanwhile, if the source data supplied to the pixel of the current frame (Fn) is changed to the uppermost gray scale from the other gray scales, the gray-scale discriminator 602 generates the first discriminator signal (SS1) of the first state. Also, if the source data supplied to the pixel of the current frame (Fn) is changed to the lowermost gray scale from the other gray scales, the gray-scale discriminator 602 generates the second discrimination signal (SS2) of the first state.

Accordingly, only when the source data supplied to each pixel of the current frame (Fn) is first changed to the lowermost or uppermost gray scale, the gray-scale discriminator 602 generates the first or second discrimination signal (SS1, SS2) of the first state.

In FIG. 4, the gate driver 114 may include a shift register that sequentially generates a scan pulse, for example, gate high pulse according to the gate control signal (GCS) supplied from the timing controller 151; and a level shifter that shifts the voltage of scan pulse to be suitable for the level of driving the liquid crystal cell (Clc). Thus, the thin film transistor is turned on in response to the scan pulse. As the thin film transistor is turned on, the video signal of the data line 115 is supplied to the pixel electrode of the liquid crystal cell (Clc).

The data driver 114 generates the first modulation voltage that is higher than the maximum gamma voltage or the second modulation voltage that is lower than the minimum gamma voltage based on the discrimination signal (SS) outputted from the timing controller 151. Also, the data driver 114 converts the modulated data (MRGB) into the video signal using the plurality of gamma voltages including the first or second modulation voltage according to the data control signal (DCS) outputted from the timing controller 151 and supplies the generated video signal to the data lines (DL1 to DLm).

Figure 8:
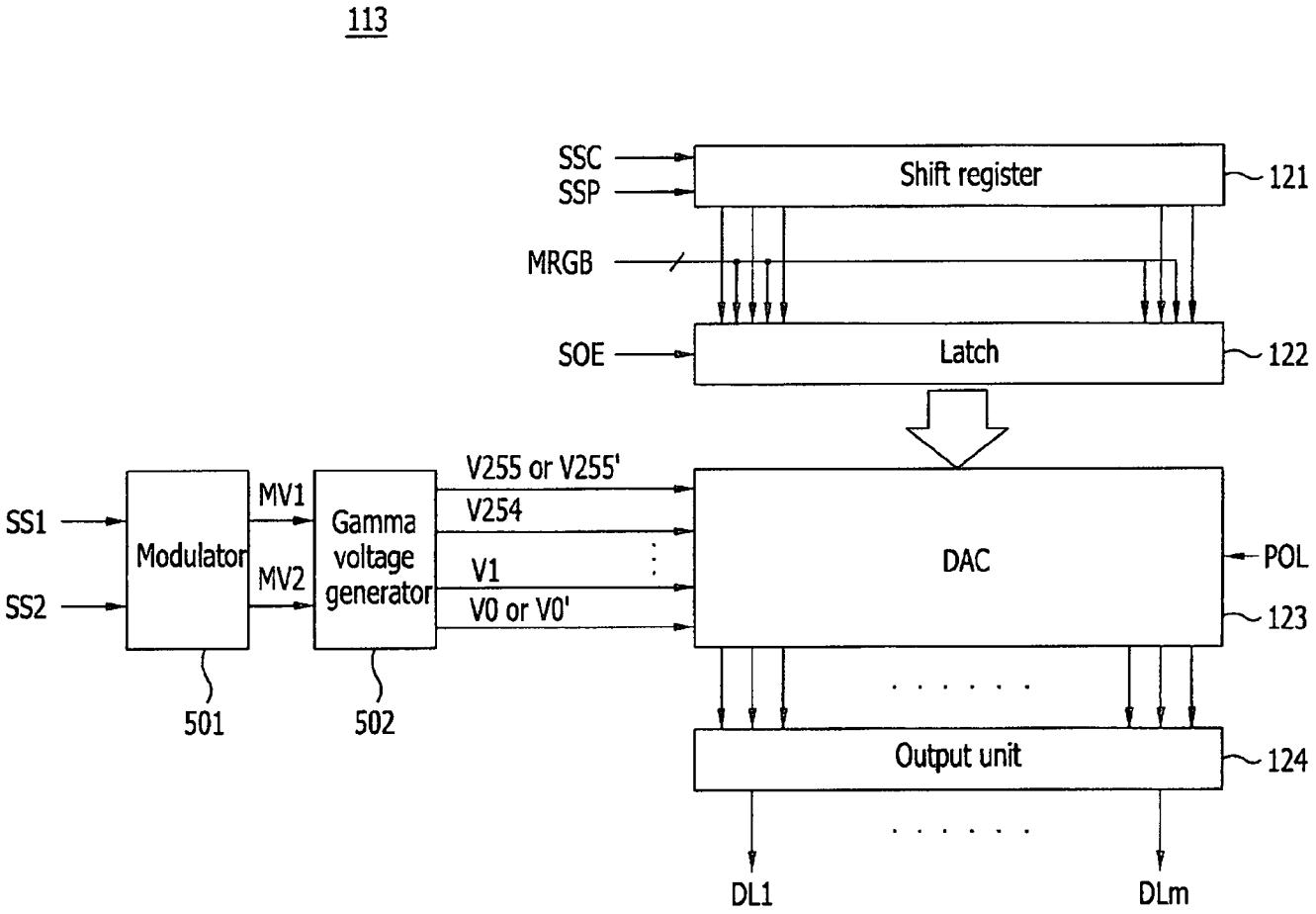
FIG. 8 is a block diagram illustrating a data driver of FIG. 4.

For this, as illustrated in FIG. 8, the data driver 114 may include a shift register 121, a latch 122, a modulator 501, a gamma voltage generator 502, a digital-analog converter 123, and an output unit 124.

The shift register 121 sequentially generates a sampling signal using source shift clock (SSC) and source start pulse (SSP) in the data control signal (DCS) provided from the timing controller 151 and supplies the generated sampling signal to the latch 122.

The latch 122 sequentially samples the modulated data (MRGB) for one horizontal line supplied from the timing controller 151 according the sampling signal outputted from the shift register 121. Also, the latch 122 supplies the modulated data (MRGB) for one horizontal line, which is sampled according to source output enable (SOE) in the data control signal (DCS) provided from the timing controller 151, to the digital-analog converter 123.

Figure 9:
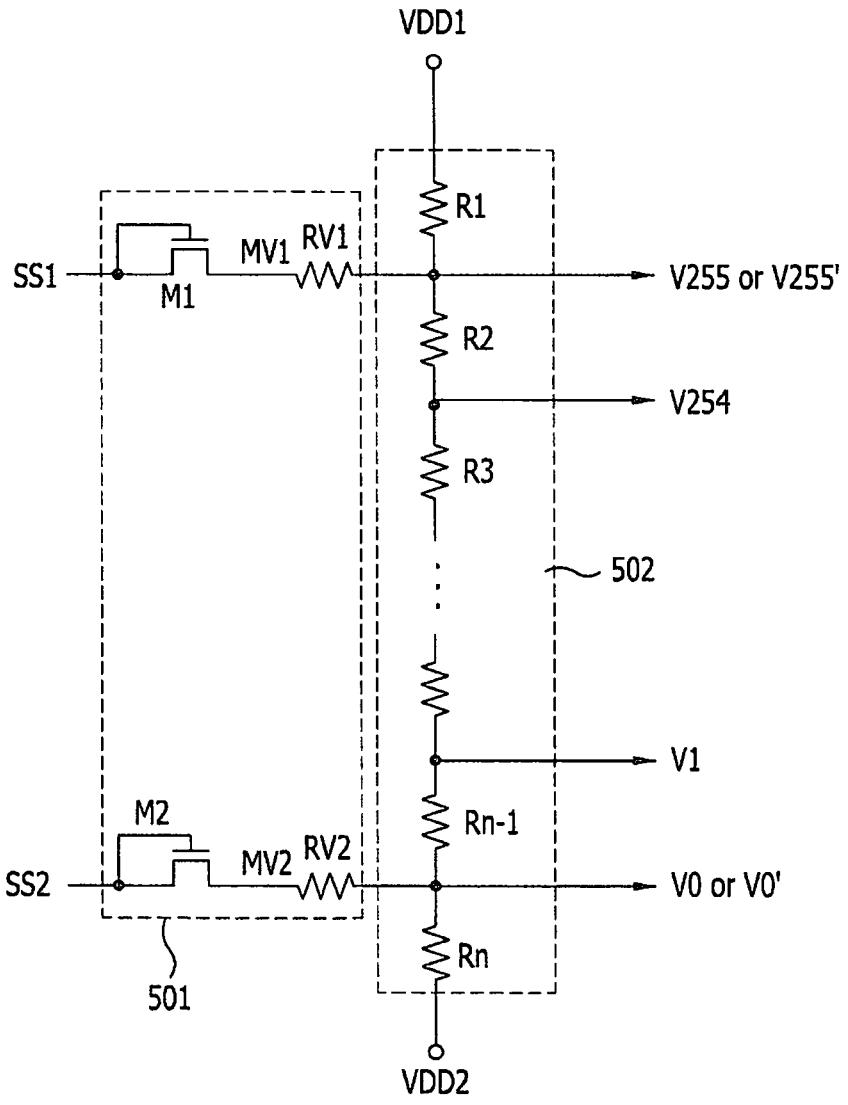
FIG. 9 illustrates a modulator and a gamma voltage generator of FIG. 8.

As illustrated in FIG. 9, the modulator 501 may include a first transistor (M1) that outputs a first compensation voltage (MV1) which is switched based on the first discrimination signal (SS1) of the timing controller 151 and a second transistor (M2) that outputs a second compensation voltage (MV2) which is switched based on the second discrimination signal (SS2) of the timing controller 151.

The first transistor (M1) may be connected to a first discrimination signal input line, to which the first discrimination signal (SS1) is supplied, in a diode connection. Thus, if the first discrimination signal (SS1) is in the high state, the first transistor (M1) outputs the first compensation voltage (MV1) corresponding to the voltage level of the high state to the gamma voltage generator 502 through a first resistor (RV1). Other configurations, including a configuration without first resistor RV1 are also possible.

The second transistor (M2) may be connected to a second discrimination signal input line, to which the second discrimination signal (SS2) is supplied, in a diode connection. Thus, if the second discrimination signal (SS2) is in the high state, the second transistor (M2) outputs the second compensation voltage (MV2) corresponding to the voltage level of the high state to the gamma voltage generator 502 through a second resistor (RV2). Other configurations, including a configuration without second resistor RV2 are also possible.

The gamma voltage generator 502 generates a plurality of gamma voltages in each of voltage-dividing nodes among a plurality of voltage-dividing resistors (R1 to Rn) connected in series between a first driving voltage (VDD1) and a second driving voltage (VDD2).

Among the voltage-dividing nodes, the uppermost voltage-dividing node may be connected with the first transistor (M1) of the modulator 501 through the first resistor (RV1). If the first discrimination signal (SS1) is in the low state, the uppermost voltage-dividing node outputs the maximum gamma voltage (V255) corresponding to the uppermost gray scale of the modulated data (MRGB) using the first and second voltage-dividing resistors (R1, R2) and the first driving voltage (Vdd1). Meanwhile, if the first discrimination signal (SS1) is in the high state, the uppermost voltage-driving node outputs a first modulation voltage (V255'), which is higher than the maximum gamma voltage (V255) corresponding to the uppermost gray scale, using the first compensation voltage (MV1), the first resistor (RV1), the first and second voltage-dividing resistors (R1, R2), and the first driving voltage (VDD1) corresponding to the first discrimination signal (SS1) of the high state.

The lowermost voltage-dividing node may be connected with the second transistor (M2) of the modulator 501 through the second resistor (RV2). If the second discrimination signal (SS2) is in the low state, the lowermost voltage-dividing node outputs the minimum gamma voltage (V0) corresponding to the lowermost gray scale of the modulated data (MRGB) using n and n−1 voltage-dividing resistors (Rn, Rn−1) and second driving voltage (VDD2). Meanwhile, if the second discrimination signal (SS2) is in the high state, the lowermost voltage-dividing node outputs a second modulation voltage (V0'), which is lower than the minimum gamma voltage (V0) corresponding to the lowermost gray scale of modulated data (MRGB) using the second compensation voltage (MV2), the second resistor (RV2), n and n−1 voltage-dividing resistors (Rn, Rn−1), and the second driving voltage (VDD2) corresponding to the second discrimination signal (SS2) of the high state.

Except the lowermost and uppermost voltage-dividing nodes, each voltage-dividing node outputs the gamma voltage between the minimum and maximum gamma voltages according to the voltage division by the voltage-dividing resistor adjacent to each voltage-dividing node.

The gamma voltage generator 502 supplies the plurality of gamma voltages (V0 or V0', V1 to V254, V255 or V255') including the first modulation voltage (V255'), which is higher than the maximum gamma voltage (V255), or the second modulation voltage (V0'), which is lower than the minimum gamma voltage (V0), to the digital-analog converter 123, according to the first or second compensation voltage (MV1, MV2) supplied from the modulator 501 by the discrimination signals (SS1, SS2).

In FIG. 8, the digital-analog converter 123 converts the latched and modulated data (MRGB) supplied from the latch 122 into the video signal by using the plurality of gamma voltages (V0 or V0', V1 to V254, V255 or V255') supplied from the gamma voltage generator 502.

The output unit 124 outputs the video signal for one horizontal line supplied from the digital-analog converter 123 to the data lines.

Only if the first or second discrimination signal (SS1, SS2) of the high stage is supplied to the data driver 113 from the timing controller 151, the data driver 113 converts the modulated data (MRGB) into the video signal by using the plurality of gamma voltages including the first and second modulation voltages (V255', V0'), and supplies the video signal to the data lines. If not, the data driver 113 converts the modulated data (MRGB) into the video signal using the plurality of gamma voltages including the uppermost (V255) and lowermost (V0) gamma voltages and supplies the video signal to the data lines.

Figure 10A:
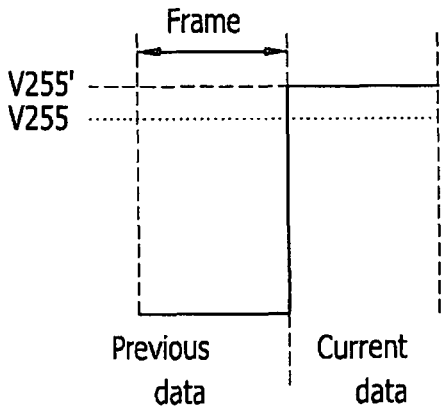
FIGS. 10A and 10B are waveform diagrams illustrating a method for driving an LCD device according to an embodiment of the present invention.

In the apparatus and method for driving the LCD device according to the present invention, if the source data supplied to the pixel of the current frame (Fn) is changed to the uppermost gray scale from the other gray scales, as illustrated in FIG. 10A, the first modulation voltage (V255'), which is higher than the maximum gamma voltage (V255), is supplied to the liquid crystal cell (Clc) so that it is possible to increase the response speed of liquid crystal for the uppermost gray scale.

Figure 10B:
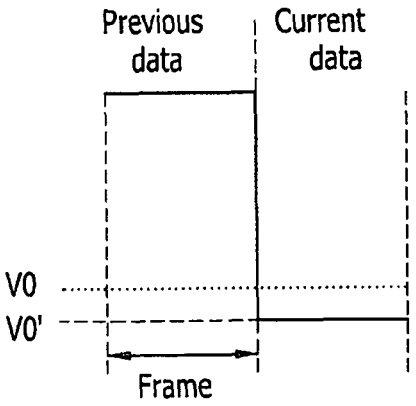

In the apparatus and method for driving the LCD device according to the present invention, if the source data supplied to the pixel of the current frame (Fn) is changed to the lowermost gray scale from the other gray scales, as illustrated in FIG. 10B, the second modulation voltage (V0'), which is lower than the minimum gamma voltage (V0), is supplied to the liquid crystal cell (Clc) so that it is possible to increase the response speed of liquid crystal for the lowermost gray scale.

As mentioned above, the apparatus and method for driving the LCD device according to the present invention has the following advantages.

In the apparatus and method for driving the LCD device according to the present invention, it is checked whether the data for each pixel of the current frame is the same as the data for each pixel of the previous frame or not. Based on the checking result, if the data for each pixel is changed to the uppermost or lowermost gray scale, the first modulation voltage, which is higher than the maximum gamma voltage, or the second modulation voltage, which is lower than the minimum gamma voltage, is supplied to the liquid crystal cell, whereby it is possible to obtain the rapid response speed of liquid crystal for the lowermost or uppermost gray scale, thereby enhancing the picture quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an LCD device, comprising:

a liquid crystal panel including liquid crystal cells formed in areas defined by gate and data lines;

a gate driver to supply a scan pulse to the gate lines;

a timing controller including an over-driving circuit to modulate source data supplied from an external source to generate modulated data by comparing source data of a current frame and source data of a previous frame, and a gray-scale discriminator to generate first and second discrimination signals by comparing the source data of a current frame with preset uppermost and lowermost gray levels among gray levels if the source data of the current frame is different from the source data of the previous frame; and a data driver to convert the modulated data into a video signal using a plurality of gamma voltages including a first compensation voltage corresponding to an uppermost gray level of the video signal and a second compensation voltage corresponding to a lowermost gray level of the video signal to supply the video signal to the data lines, wherein the data driver includes:

a discrimination signal switch to generate the first and the second compensation voltages according to the first and the second discrimination signals; and a gamma voltage generator to generate the plurality of gamma voltages and a first over-driving voltage that is higher than a maximum gamma voltage, and a second over-driving voltage that is lower than a minimum gamma voltage, according to the first and the second compensation voltages, respectively, wherein the gamma voltage generator generates the plurality of gamma voltages for output via n−1 voltage-dividing nodes respectively formed between each adjacent pair of n voltage-dividing resistors connected in series between a first driving voltage and a second driving voltage, the n voltage driving nodes including an uppermost voltage-dividing node formed between the first two resistors of the n voltage-dividing resistors and a lowermost voltage-dividing node formed between the last two resistors of the n voltage-dividing resistors, wherein the discrimination signal switch comprises:

a first transistor (M1) to turn on and off the first discrimination signal and generate the first compensation voltage; and a second transistor (M2) to turn on and off the second discrimination signal and generate the second compensation voltage, wherein when the first transistor (M1) is turned on by receiving the first discrimination signal (SS1) through source and gate electrodes of the first transistor (M1) in a diode configuration, the first compensation voltage is supplied to the uppermost voltage-dividing node, which is then added to the maximum gamma voltage, such that the data driver outputs the first over-driving voltage, and when the first transistor (M1) is turned off the first compensation voltage is not generated and the data driver outputs the maximum gamma voltage, wherein, according to the first discrimination signal (SS1), the first transistor (M1) is selectively connected with the uppermost voltage-dividing node through a first resistor (RV1) of the discrimination signal switch, wherein when the second transistor (M2) is turned on by receiving the second discrimination signal (SS2) through source and gate electrodes of the second transistor (M2) in a diode configuration, the second compensation voltage is supplied to the lowermost voltage-dividing node, which is then added to the minimum gamma voltage, such that the data driver outputs the second over-driving voltage, and when the second transistor (M2) is turned off the second compensation voltage is not generated and the data driver outputs the minimum gamma voltage, and wherein, according to the second discrimination signal (SS2), the second transistor (M2) is selectively connected with the lowermost voltage-dividing node through a second resistor (RV2) of the discrimination signal switch.

2. The apparatus of claim 1, wherein the over-driving circuit comprises:

a frame memory to store the source data; and a look-up table to generate the modulated data by comparing the source data of the current frame with the source data of the previous frame outputted from the frame memory.

3. The apparatus of claim 1, wherein the uppermost voltage-dividing node outputs the maximum gamma voltage or the first over-driving voltage according to the first discrimination signal, and the lowermost voltage-dividing node outputs the minimum gamma voltage or the second over-driving voltage according to the second discrimination signal.

4. The apparatus of claim 1, wherein if the first transistor connects with the uppermost voltage-dividing node according to the first discrimination signal, the first transistor outputs the first discrimination signal, as the first compensation voltage, to the uppermost voltage-dividing node through the first resistor so that the maximum gamma voltage of the uppermost voltage-dividing node increases into the first over-driving voltage, and wherein if the second transistor connects with the lowermost voltage-dividing node according to the second discrimination signal, the second transistor outputs the second discrimination signal, as the second compensation voltage, to the lowermost voltage-dividing node through the second resistor so that the minimum gamma voltage of the lowermost voltage-dividing node decreases into the second overdriving voltage.

5. An apparatus for driving an LCD device, comprising:

a timing controller including an over-driving circuit to modulate source data supplied from an external source to generate modulated data by comparing source data of a current frame and source data of a previous frame, and a gray-scale discriminator to generate first and second discrimination signals by comparing the source data of a current frame with preset uppermost and lowermost gray levels among gray levels if the source data of the current frame is different from the source data of the previous frame; and a discrimination signal switch to generate first and second compensation voltages according to the first and the second discrimination signals; and a gamma voltage generator to generate a plurality of gamma voltages and a first over-driving voltage that is higher than a maximum gamma voltage, and a second over-driving voltage that is lower than a minimum gamma voltage, according to the first and the second compensation voltages, respectively, wherein the gamma voltage generator generates the plurality of gamma voltages for output via n−1 voltage-dividing nodes respectively formed between each adjacent pair of n voltage-dividing resistors connected in series between a first driving voltage and a second driving voltage, the n voltage driving nodes including an uppermost voltage-dividing node formed between the first two resistors of the n voltage-dividing resistors and a lowermost voltage-dividing node formed between the last two resistors of the n voltage-dividing resistors, wherein the discrimination signal switch comprises:

a first transistor (M1) to turn on and off the first discrimination signal and generate the first compensation voltage; and a second transistor (M2) to turn on and off the second discrimination signal and generate the second compensation voltage, wherein when the first transistor (M1) is turned on by receiving the first discrimination signal (SS1) through source and gate electrodes of the first transistor (M1) in a diode configuration, the first compensation voltage is supplied to the uppermost voltage-dividing node, which is then added to the maximum gamma voltage, such that the gamma voltage generator outputs the first over-driving voltage, and when the first transistor (M1) is turned off the first compensation voltage is not generated and the gamma voltage generator outputs the maximum gamma voltage, wherein, according to the first discrimination signal (SS1), the first transistor (M1) is selectively connected with the uppermost voltage-dividing node through a first resistor (VR1) of the discrimination signal switch, wherein when the second transistor (M2) is turned on by receiving the second discrimination signal (SS2) through source and gate electrodes of the second transistor (M2) in a diode configuration, the second compensation voltage is supplied to the lowermost voltage-dividing node, which is then added to the minimum gamma voltage, such that the gamma voltage generator outputs the second over-driving voltage, and when the second transistor (M2) is turned off the second compensation voltage is not generated and the gamma voltage generator outputs the minimum gamma voltage, and wherein, according to the second discrimination signal (SS2), the second transistor (M2) is selectively connected with the lowermost voltage-dividing node through a second resistor (VR2) of the discrimination signal switch.

6. The apparatus of claim 5, wherein the over-driving circuit comprises:

a frame memory to store the source data; and a look-up table to generate the modulated data by comparing the source data of the current frame with the source data of the previous frame outputted from the frame memory.

7. The apparatus of claim 6, wherein the gray-scale discriminator comprises:

a first comparator to generate a comparison signal by comparing the source data of the current frame with the source data of the previous frame outputted from the frame memory;

a selector to selectively output the source data of the current frame according to the comparison signal;

a second comparator to generate the first discrimination signal by comparing the source data of the current frame supplied from the selector with a first reference signal corresponding to a preset uppermost gray scale; and a third comparator to generate the second discrimination signal by comparing the source data of the current frame supplied from the selector with a second reference signal corresponding to a preset lowermost gray scale.

8. The apparatus of claim 5, wherein the uppermost voltage-dividing node outputs the maximum gamma voltage or the first over-driving voltage according to the first discrimination signal, and the lowermost voltage-dividing node outputs the minimum gamma voltage or the second over-driving voltage according to the second discrimination signal.

9. The apparatus of claim 5, wherein if the first transistor connects with the uppermost voltage-dividing node according to the first discrimination signal, the first transistor outputs the first discrimination signal, as the first compensation voltage, to the uppermost voltage-dividing node through the first resistor so that the maximum gamma voltage of the uppermost voltage-dividing node increases into the first over-driving voltage, and wherein if the second transistor connects with the lowermost voltage-dividing node according to the second discrimination signal, the second transistor outputs the second discrimination signal, as the second compensation voltage, to the lowermost voltage-dividing node through the second resistor so that the minimum gamma voltage of the lowermost voltage-dividing node decreases into the second over-driving voltage.

* * * * *